US006253753B1

(12) United States Patent
Blum et al.

(10) Patent No.: US 6,253,753 B1
(45) Date of Patent: Jul. 3, 2001

(54) RELEASE MOUNTED ARROW SHAFT GRIPPER

(75) Inventors: Casey Blum, Sauk City; Lynn A. Tentler, Fond du Lac, both of WI (US)

(73) Assignee: Tru-Fire Corporation, North Fond du Lac, WI (US)

( * ) Notice: Subject to any disclaimer, the term of this patent is extended or adjusted under 35 U.S.C. 154(b) by 0 days.

(21) Appl. No.: 09/663,034

(22) Filed: Sep. 15, 2000

(51) Int. Cl.[7] ..... F41B 5/18
(52) U.S. Cl. ..... 124/35.2; 124/86; 294/99.1
(58) Field of Search ..... 124/1, 35.2, 86, 124/88, 89; 254/18; 294/99.1

(56) References Cited

U.S. PATENT DOCUMENTS

| | | | | |
|---|---|---|---|---|
| 3,604,407 | * | 9/1971 | Wilson | 124/35.2 |
| 3,873,068 | * | 3/1975 | Allen . | |
| 3,890,692 | * | 6/1975 | Jandura . | |
| 4,509,497 | | 4/1985 | Garvison . | |
| 4,584,983 | * | 4/1986 | Ament | 124/89 |
| 4,831,997 | | 5/1989 | Greene . | |
| 5,020,508 | | 6/1991 | Greene, Jr. | 124/35.2 |
| 5,261,581 | * | 11/1993 | Harden | 124/35.2 X |
| 5,323,754 | * | 6/1994 | Pittmann et al. | 124/35.2 |
| 5,364,148 | | 11/1994 | Bartocci . | |
| 5,544,926 | | 8/1996 | Ravencroft | 294/1.1 |
| 5,615,662 | | 4/1997 | Tentler et al. | 124/35.2 |
| 5,653,214 | * | 8/1997 | Lynn | 124/35.2 |
| 6,125,833 | | 10/2000 | Tentler et al. | 124/35.2 |

OTHER PUBLICATIONS

Cabelas Fall 1998 Catalog on–line version Available from www.cabelas.com Arrow Puller Pack With Gorilla Grip and Gorilla Grip Arrow Puller.

* cited by examiner

*Primary Examiner*—John A. Ricci
(74) *Attorney, Agent, or Firm*—Ryan Kromholz & Manion, S.C.

(57) ABSTRACT

An arrow gripping structure for selectively grasping an arrow shaft is disclosed carried by a bow string release for selectively securing and releasing the string of a bow for firing an arrow therefrom. The arrow gripping structure can be carried by a wide varied of release body structures such as glove style releases, wrist strap releases, and hand-held releases. Also disclosed is a method of pulling arrows from a target by providing a bowstring release with an arrow gripping member, grasping an arrow, and pulling the arrow away from the target, and a method of using a bowstring release to remove arrows from a target.

40 Claims, 7 Drawing Sheets

RELEASE MOUNTED ARROW SHAFT GRIPPER

BACKGROUND OF THE INVENTION

A. Field of Invention

This invention generally relates to gripping devices, and more precisely to a small hand carried flexible and resilient gripping member structured for assisting in the manual pulling of an arrow from a target, the gripping member coupled with a release device.

B. Description of Related Art

Bowstring releases have grown rapidly in popularity for target shooting and for hunting. A good release provides uniform and consistent release of the bowstring and thus increases accuracy. The release is typically either hand-held or strapped to the wrist and is provided with a trigger that permits the archer to activate a string retaining and releasing mechanism.

When target shooting, pulling arrows from a target is a particular problem. Pulling arrows from a target has become more difficult with the increasingly popular three-dimensional animal targets now in use, in addition to traditional foam, straw, or other targets. These life sized 3-Dimensional targets are made of rigid urethane foam and structured to appear like live animals such as deer, elk or smaller animals such as turkeys. Targets such as those sold by McKenzie Sports Products Inc. are designed to self-heal or close up holes created by arrow and arrow head penetration. The self-healing action, although desirable for minimizing target wear and tear, increases frictional resistance between the target material and an arrow shaft.

The increased power produced by modern compound bows also embeds the arrows deeper into the target, making the arrows even more difficult to pull out. In addition, modern carbon arrows present a smaller diameter, increasing the depth of penetration, and increasing the surface area of the arrow shaft presented to the target for frictional resistance. Arrows become embedded into the targets sufficiently so that it is often difficult to pull the arrows out by hand.

When shooting, an archer usually wears the release on the archer's dominant hand; i.e., a right handed archer wears the release on the right hand. When target shooting, the archer releases arrows directed at a target and then must retrieve the arrows from the target. Ordinarily, archers generally prefer to remove the arrows from the target with the palm and/or fingers of their dominant hand, often while holding the target in place with the archer's weak hand. However, the fingers and palm of the dominant hand are often obstructed by the release, necessitating that the archer reposition the release from a firing position to an out-of-the-way position, so that the archer can properly grip the arrow shaft. If a glove-type release is used, such as the Tru-Fire BearPaw release, the archer must ordinarily completely remove the release from the hand in order to grip the arrow shaft adequately.

The skin on an archer's palm presents a more frictionally resistant surface than the release because of the materials that are traditionally used during manufacturing. However, the release generally obstructs the archer's palm. If the archer does not remove the release, the release is typically unable to provide an adequate frictional surface because the release is often constructed of soft fabric that provides very little frictional resistance, such as fleece, nylon, canvas or Saddle-Cloth® fabric.

Because archers often shoot a series of arrows, retrieve the arrows, and then shoot another series of arrows when target shooting, removing the release from the hand and replacing the release on the hand becomes tedious between repetitions.

The primary problem is getting a good grip on the arrow shaft without the hands slipping, or in providing sufficient pulling pressure with a slippery grip.

To solve this problem, archers and hunters often use a frictionally adhesive piece of flat sheet material, such as synthetic rubber or plastic, to help provide a better grip over the arrow shaft and assist in pulling the arrow. Excessive gripping or squeezing strength is still required to remove the arrow from the target, and this solution also leads to archers losing the frictionally adhesive piece of flat sheet material because it is not attached to anything.

Although there have been devices provided in the past for assisting in pulling arrows from targets such as the rubbery flat sheet material mentioned above, the structure disclosed in U.S. Pat. No. 5,544,926 issued to Ravencroft, and a device known commercially as the "Gorilla Grip," these devices are not operatively disposed on the release. Instead, the archer must still move the release out of the firing position, or must remove the release from the hand altogether, or must run the risk of losing the arrow puller or forgetting to bring the arrow puller to the firing range.

SUMMARY OF THE INVENTION

The present invention is a resilient gripping member coupled to a bowstring release, the gripping member sized for placement adjacent to or over a portion of an arrow shaft. Preferably, the gripping member is manufactured of a stiff yet somewhat flexible rubbery material that contacts the surface of the arrow shaft and is sufficiently flexible to mold about and frictionally adhere to an exposed surface of an arrow shaft partially embedded in a target. When the gripping member is grasped firmly and squeezed by the fingers of a user, the gripping member grasps a portion of the arrow shaft providing a frictionally effective grip about the arrow shaft. Alternatively, the gripping member provides a frictional surface between the release body and the fingers, allowing an archer to grasp the arrow shaft between the fingers and the gripping member.

When the present gripping member is applied to an arrow shaft and squeezed either about the arrow or between the gripping member and the archer's fingers, the grip will not slide along the arrow. Pulling pressure applied to the grip is more efficiently applied to the arrow shaft, reducing the amount of gripping pressure, which in turn eases the pulling of the arrow from the target.

The gripping member can comprise a wide range of geometric shapes. For instance, the gripping member can comprise a flat piece of frictionally enhancing material disposed on a release body, or a release body structure. The gripping member can comprise a roughly semi-tubular shaped member with an opening provided along the length of the gripping member to allow the gripping member to receive the arrow shaft.

The gripping member can be attached to any type of release body structure, such as a hand-held or wrist strap style release, including for example but not by limitation the previously mentioned Tru-Fire BearPaw® release, a release known commercially as Winn Free Flight release, a Cobra Armstrong type glove, wrist strap styles such as used on a Tru-Fire Storm release (not shown) or a strap described in U.S. Pat. No. 4,831,997 to Greene, and hand-held styles (not shown).

Therefore, the combined features of the invention serve to provide the user with ease in removing an arrow from a target, providing the archer with a convenient and force efficient method to remove arrows from a target without removing the release from the hand or wrist.

DETAILED DESCRIPTION

Although the disclosure hereof is detailed and exact to enable those skilled in the art to practice the invention, the physical embodiments herein disclosed merely exemplify the invention which may be embodied in other specific structure. While the preferred embodiment has been described, the details may be changed without departing from the invention, which is defined by the claims.

The present invention is intended for use in any release body type, or release body structure type, generally comprising glove styles such as a Tru-Fire BearPaw® release glove as shown throughout the drawings or a Cobra Armstrong type glove, wrist strap styles such as used on a Tru-Fire Storm release (not shown) or a strap described in U.S. Pat. No. 4,831,997 to Greene, and hand-held styles (not shown) known in the art. For the purpose of defining the claims, an arrow gripping structure comprises both an arrow gripping mechanism and an arrow gripping member.

Figure 1:
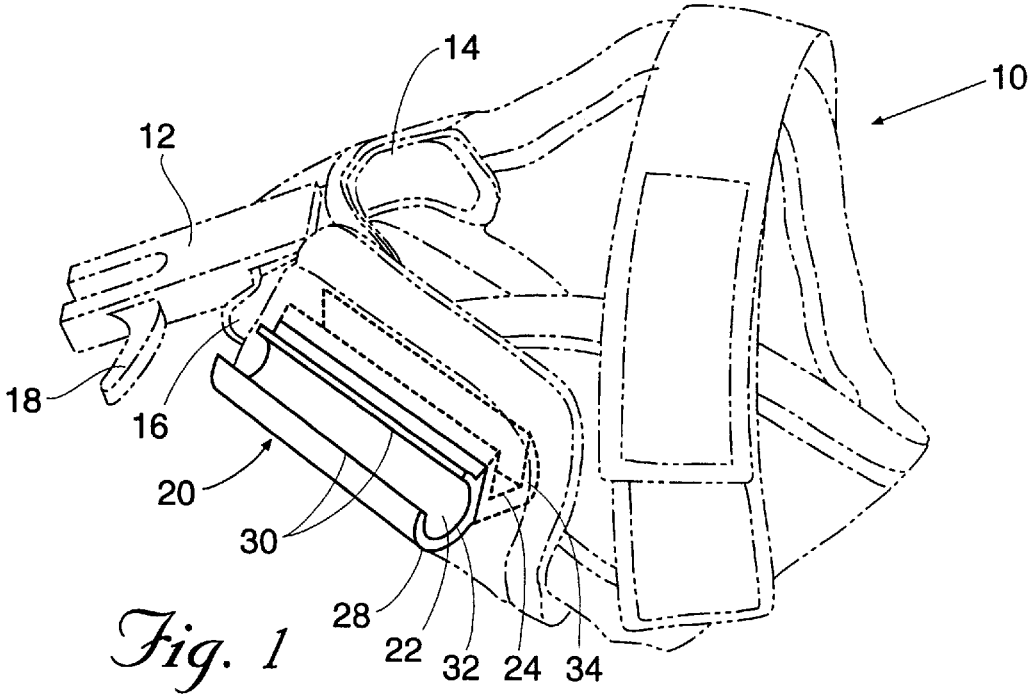
FIG. 1 is a perspective view of a release mounted arrow shaft gripper, and an arrow gripping member.

Referring now to FIG. 1, a perspective view of a release mounted arrow shaft gripper is generally shown as 10. The release mounted arrow shaft gripper 10 has a release body structure 14, depicted as a glove style but that can vary widely as described above. The release body structure 14 provides a hub for carrying other elements of the release mounted arrow shaft gripper 10. The release mounted arrow shaft gripper 10 is provided with an arrow gripping member 20 that is carried by the release body structure 14. The release mounted arrow shaft gripper 10 is capable of releasing a string of a bow with a release mechanism 12, and is also capable of grasping the shaft of an arrow with the arrow gripping member 20. A trigger 18 is provided to actuate the release mechanism 12. The components of the release mounted arrow shaft gripper 10 can be joined through numerous mechanisms, including stitching, gluing, or heat sealing for joining soft elements such as fabric, leather and rubber; and bolting, securing, or fastening for joining harder elements such as metal release elements.

The arrow gripping member 20 is configured to receive the shaft of an arrow, the shaft ordinarily circular in cross section. The arrow gripping member 20 is preferably disposed on the release body structure 14 in an overlying relationship with an archer's palm when the archer wears the release mounted arrow shaft gripper 10. Also preferably, the arrow gripping member 20 is oriented roughly perpendicularly to fingers of the archer along the length of the arrow gripping member 20 when the archer is wearing the release mounted arrow shaft gripper 10. This geometric relationship is advantageous because it allows an archer to curl his or her fingers about the arrow gripping member 20, place the arrow shaft within an arrow receiving void 22 of the arrow gripping member, and then apply gripping and pulling forces to the arrow gripping member 20.

In a preferred embodiment, the arrow receiving void is formed by an arrow gripping member main body 28. The arrow gripping member main body 28 is preferably roughly "C" shaped in cross section, forming two parallel rails 30, between which the archer can place the arrow shaft. The arrow gripping member main body 28 presents an arrow gripping surface 32 in an interior of the "C" shape.

Although the arrow gripping member 20 of the preferred embodiment has solid and continuous parallel rails 30 and a cross section as described above, any shape may be used that is suitable for gripping an arrow. Different cross sections, such as "U" shapes, or parallel rails 30 that are non-continuous along the length, or that grip the arrow using only a portion of the length, may be utilized without departing from the present invention.

Also preferably, the arrow gripping member main body 28 is coupled with a support member coupling body 34 having a support member straddle void 24. In this embodiment, the support member straddle void 24 fits over a support member 16 coupled with the release body structure 14. The support member coupling body 34 and support member straddle void 24 can act as a finger pad as disclosed in U.S. Pat. No. 4,509,497 issued to Garvison and U.S. Pat. No. 4,426,989 issued to Sutton. However, as will be described later, the support member 16 and the support member coupling body 34 and the support member straddle void are not required, because other means are available for coupling the arrow gripping member 20 with the release body structure 14, and because the benefit of a finger pad is not required.

The arrow gripping member 20 can be constructed with a wide range of materials. Preferable material characteristics are sufficient resiliency, sufficient frictional adherence between the material and arrow shaft material such as aluminum or carbon, and pliability to conform to or contact the majority of the exterior surface of the arrow shaft. The material is resilient so that the rail or rails 30 automatically separate from each other upon release of pressure, but flexible enough to be easily squeezed by hand onto the arrow shaft. Elastomers have been found to perform suitably. Another preferable but not necessary material characteristic is a minimally odoriferous material, because animals and hunters alike are very sensitive to human scent in the woods.

Many natural and synthetic materials can be used to make the arrow gripping member 20, and the material of the arrow gripping member 20 is preferably rubbery material, such as a 50+/−10 durometer hardness natural gum rubber for example. Other examples of materials that may perform suitably depending on archer preference are neoprene or semi-rigid foam, because these materials may expel less scent. Preferably one single material is used to construct the arrow gripping member 20, made in an integral molding process such as by extrusion, pultrusion or injection molding. These processes allow the arrow gripping member 20 to be made inexpensively. However, the arrow gripping member 20 could be constructed of a different material, and then coated with a material that enhances cohesiveness between the arrow gripping member 20 and the arrow shaft.

Figure 2:
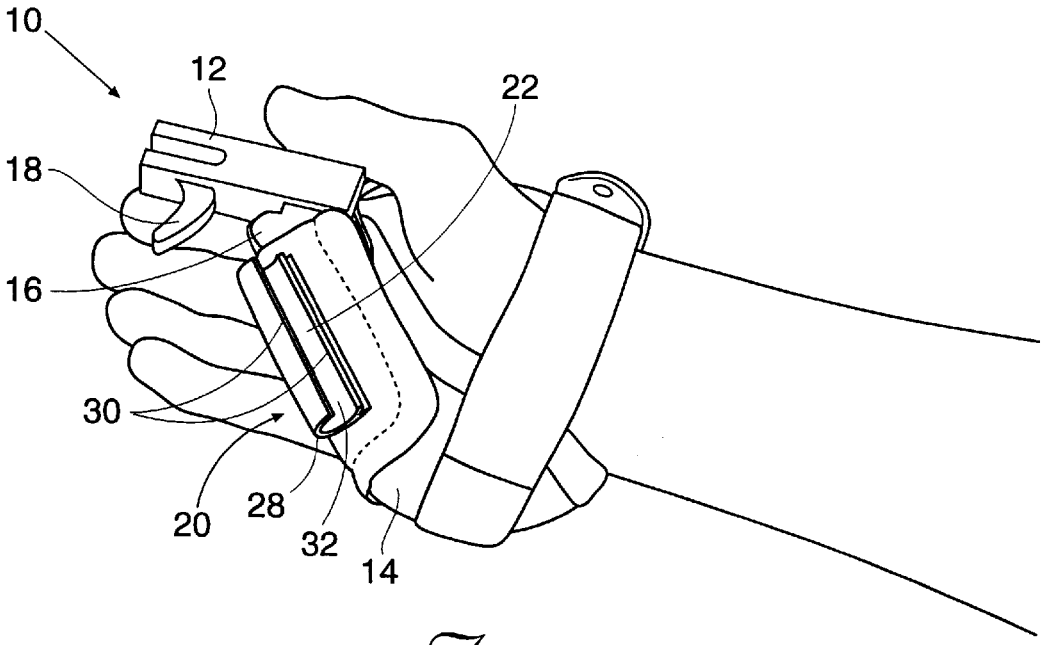
FIG. 2 is a perspective view of an archer's hand carrying the release mounted arrow shaft gripper.

Referring now to FIG. 2, the release mounted arrow shaft gripper is shown worn by an archer. The archer can engage the trigger 18 with an index finger when shooting the arrow. As shown by comparing FIG. 1 with FIG. 2, it is a preferable fabrication detail that the support member coupling body 34 and the support member straddle void 24 be concealed behind a fabric portion of the release body structure 14, exposing to the surface the arrow gripping member main body 28 and the arrow gripping surface. This arrangement provides enhanced aesthetics and also provides a comfortable grip when the archer pulls the bow string back for firing.

Figure 3:
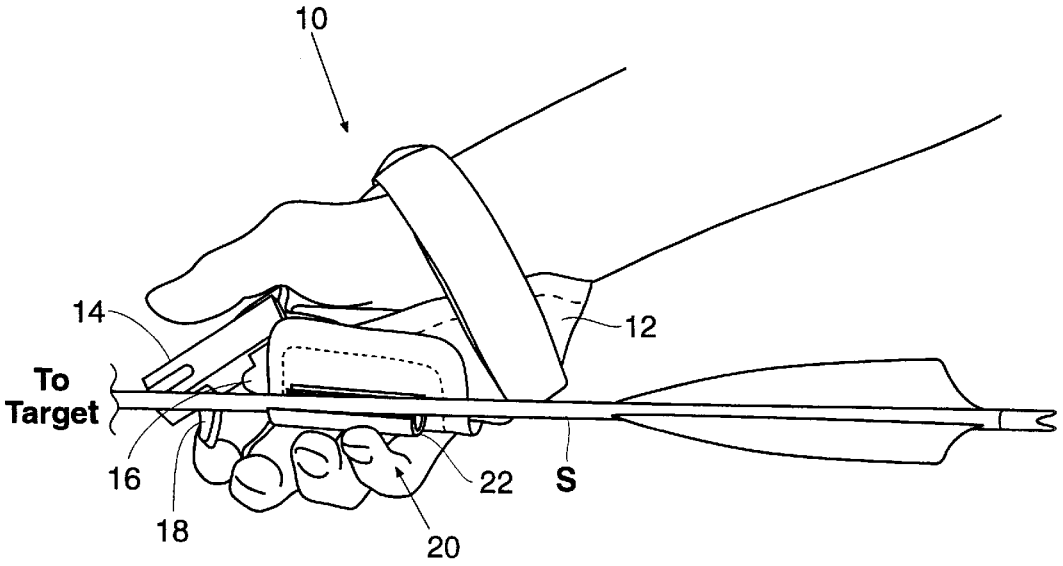
FIG. 3 is a perspective view of an archer's hand carrying the release mounted arrow shaft gripper, the arrow gripping member engaging an arrow shaft.

Referring now to FIG. 3, after the archer releases an arrow or arrows, the archer approaches the target and can engage an arrow shaft S as shown. The archer aligns the shaft S with the arrow receiving void 22. Typically, the archer will be facing the target, and thus the archer's thumb and index fingers will be the closest fingers to the target.

Figure 4:
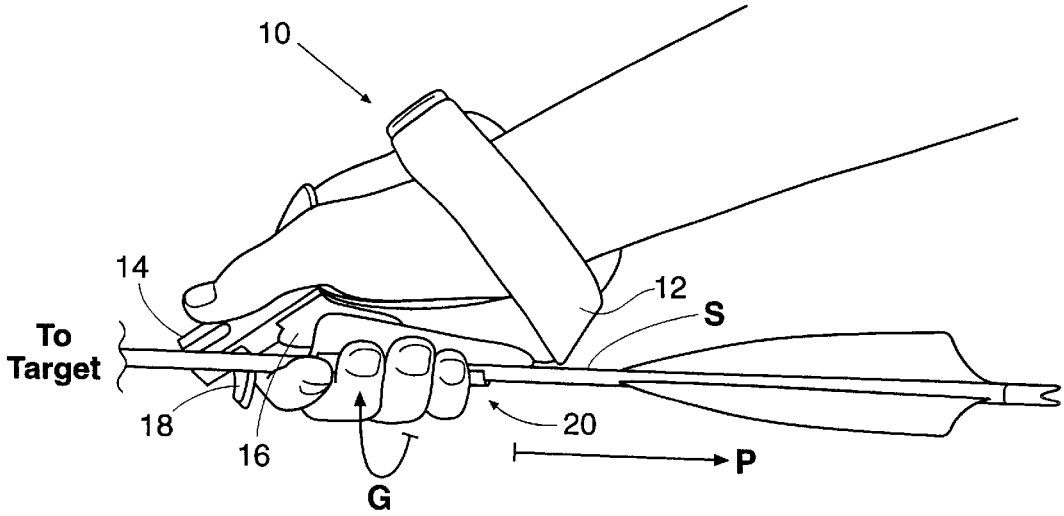
FIG. 4 is a perspective view of an archer's hand applying finger gripping force and pulling force to an arrow shaft using the release mounted arrow shaft gripper and the arrow gripping member.

Referring now to FIG. 4, the archer applies finger gripping force G and pulling force P to the arrow shaft S using the release mounted arrow shaft gripper 10. The archer can apply gripping force G from the archer's fingers to the arrow gripping member 20. The arrow gripping member 20 in turn grips the arrow shaft S. Once the archer has the shaft S engaged, the archer simultaneously with the application of gripping force G, applies the pulling force P in a direction away from the target and generally parallel to an axis of the shaft S. Because of the frictional advantage provided by the arrow gripping member 20, the archer does not have to apply as much gripping force G and pulling force P as would be required without the arrow gripping member 20.

Figure 5:
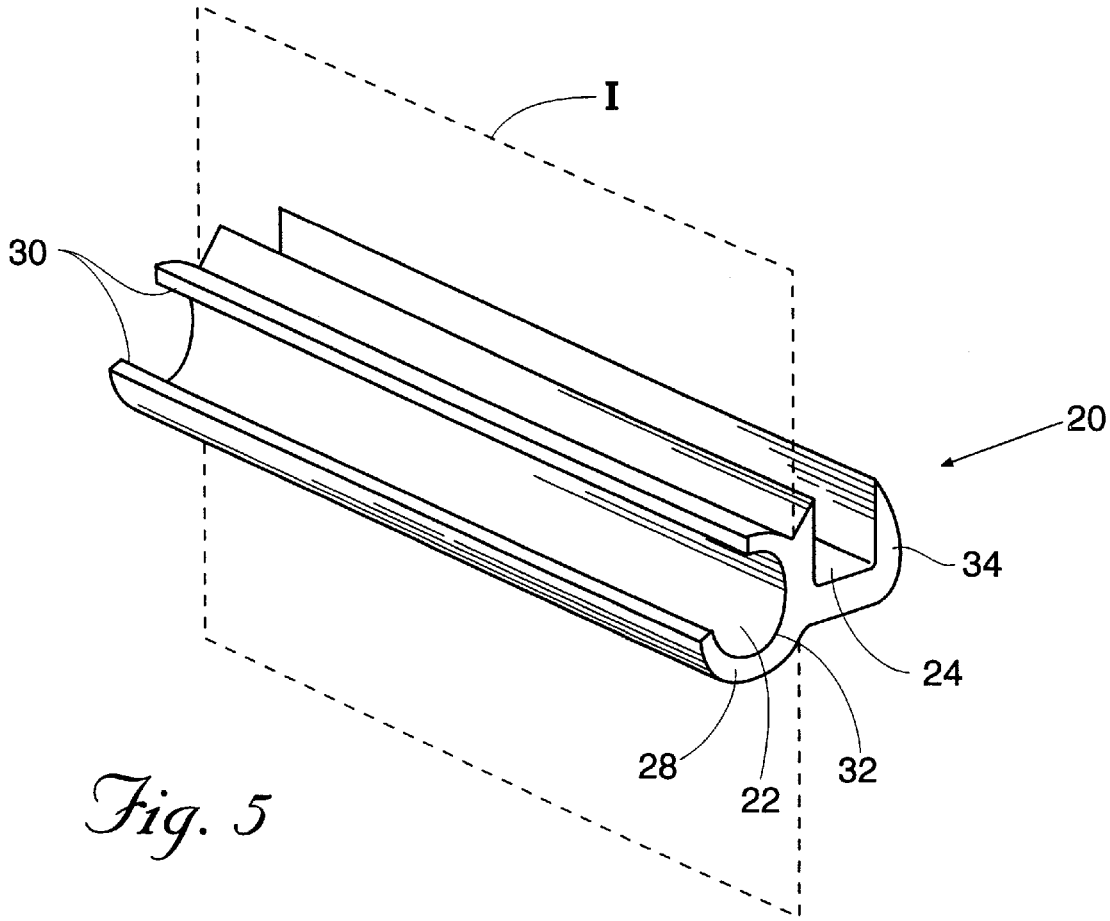
FIG. 5 is a perspective view of an embodiment arrow gripping member, showing in phantom a preferred interface between concealed and exposed surfaces of the arrow gripping member.

Referring now to FIG. 5, a perspective view of a preferred embodiment of the arrow gripping member 20 is shown with a preferred interface I between concealed and exposed surfaces of the arrow gripping member in phantom. The support member coupling body 34 and the support member straddle void 24 carried by the support member 16, can act as a finger pad, permitting the archer to wrap the fingers around the release body structure 14 and enhance pulling on the bow string. The interface I is a preferred plane in which a void in the fabric of the release body structure 14 (not shown) can be provided to conceal the support member coupling body 34 and the support member straddle void 24. This void in the fabric also eases fabrication of the release mounted arrow shaft gripper 10.

Figure 6:
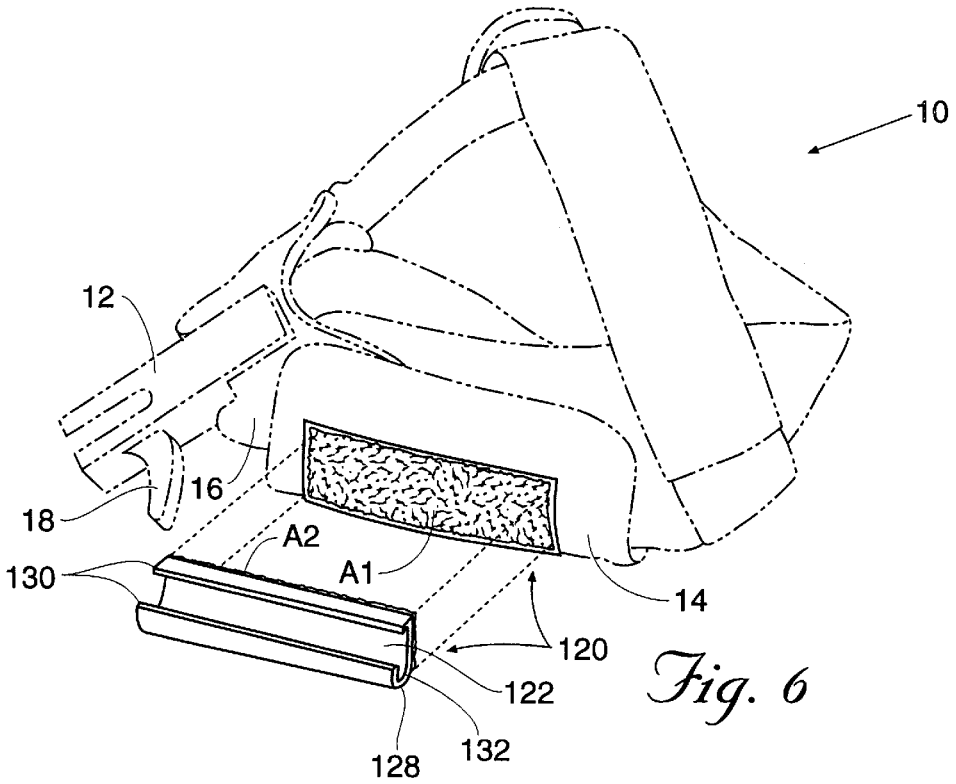
FIG. 6 is an exploded view of a first alternate embodiment of a release mounted arrow gripping member.

Referring now to FIG. 6, an exploded view of a first alternate embodiment of a release mounted arrow gripping member 120 is shown. In this embodiment, the release mounted arrow gripping member 120 is not equipped with the support member coupling body 34 or the support member 16. Instead, the release body structure 14 carries adherent surface A1. The release mounted arrow gripping member 120 carries adherent surface A2. Adherent surface A1 and adherent surface A2 are then coupled together if the archer wishes to employ the release mounted arrow gripping member 120. This releasable arrangement provides the archer with the choice of removing the release mounted arrow gripping member 120 during hunting conditions.

The release mounted arrow gripping member 120 retains the same general "C" shape, with an arrow receiving void 122 provided, as well as an arrow gripping member main body 128, rails 130 and an arrow gripping surface 132.

Because of the desirability of a detachable release mounted arrow gripping member 120, adherent surfaces A1 and A2 preferably retain adherence during repeated detachments and attachments. A hook and loop type fastening system, such as a Velcro® hook and loop type fastening system has been found to perform suitably. Another mechanism for allowing repeated attachment and detachment would be to provide a void on release body structure, and to provide a similarly sized attachment on the arrow gripping member 120, to function in sliding engagement, similar to a wallet insert. However, other repeatedly detachable and attachable mechanisms would perform suitably. Examples of other repeatedly detachable and attachable mechanisms include snaps, zippers, clasps, buckles, threaded fasteners and non-threaded fasteners, although other repeatedly detachable and attachable mechanisms may be used without departing from the present invention.

Figure 7:
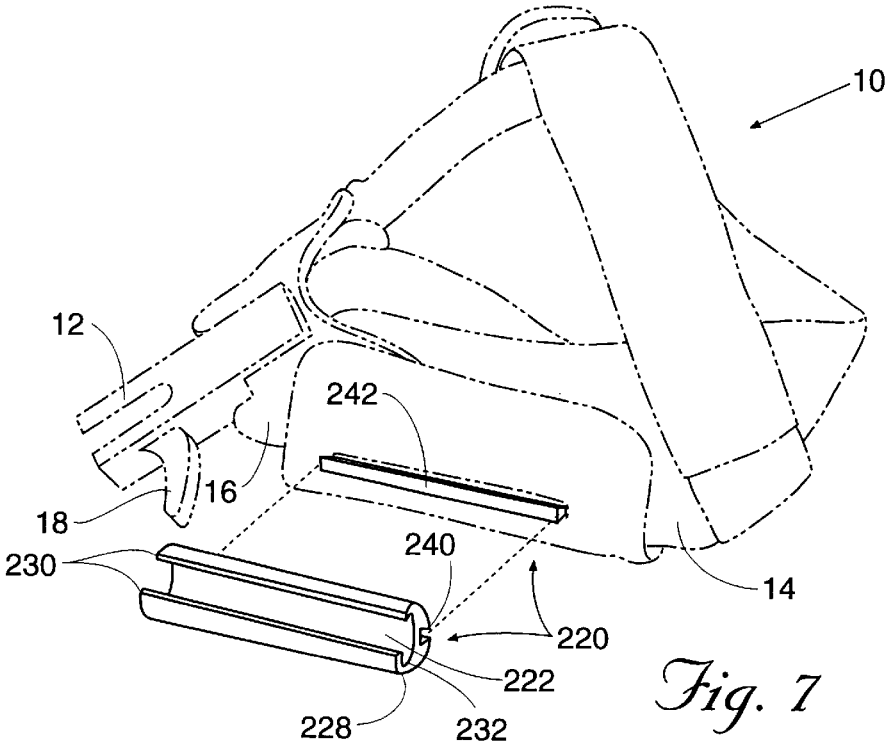
FIG. 7 is an exploded view of a second alternate embodiment of a release mounted arrow gripping member.

Referring now to FIG. 7, a second alternate embodiment of a release mounted arrow gripping member 220 is shown. Like the first alternate embodiment of the release mounted arrow gripping member 120, the release mounted arrow gripping member 220 is detachable. In this embodiment, and tongue and groove arrangement is used for attachment and detachment. A groove 240 is shown provided as a void on an arrow gripping member 228. A tongue 242 is provided coupled to the release body structure 14. Of course, the tongue 242 could be placed on the arrow gripping member 228 and the groove 240 on the release body structure 14.

The release mounted arrow gripping member 220 retains the same general "C" shape, with an arrow receiving void 222 provided, as well as the arrow gripping member main body 228, rails 230 and an arrow gripping surface 232.

Figure 8:
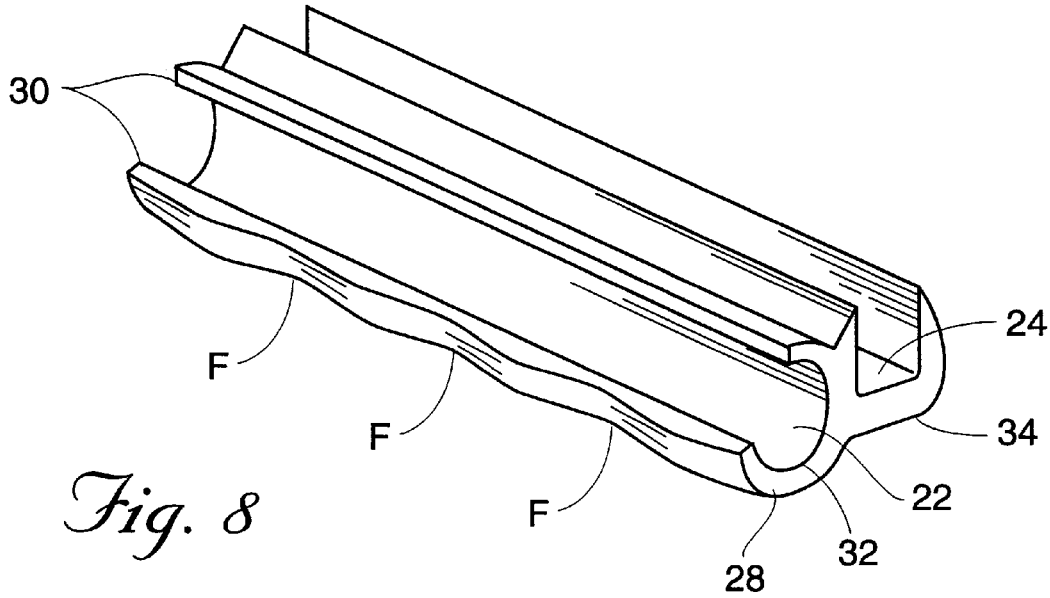
FIG. 8 is a perspective view of a third alternate embodiment of a release mounted arrow gripping member.

Referring now to FIG. 8, a third alternate embodiment of a release mounted arrow gripping member is shown. In this embodiment, finger gripping depressions F are provided on the arrow gripping member main body 28, but could also be used on other alternate embodiments.

Figure 9:
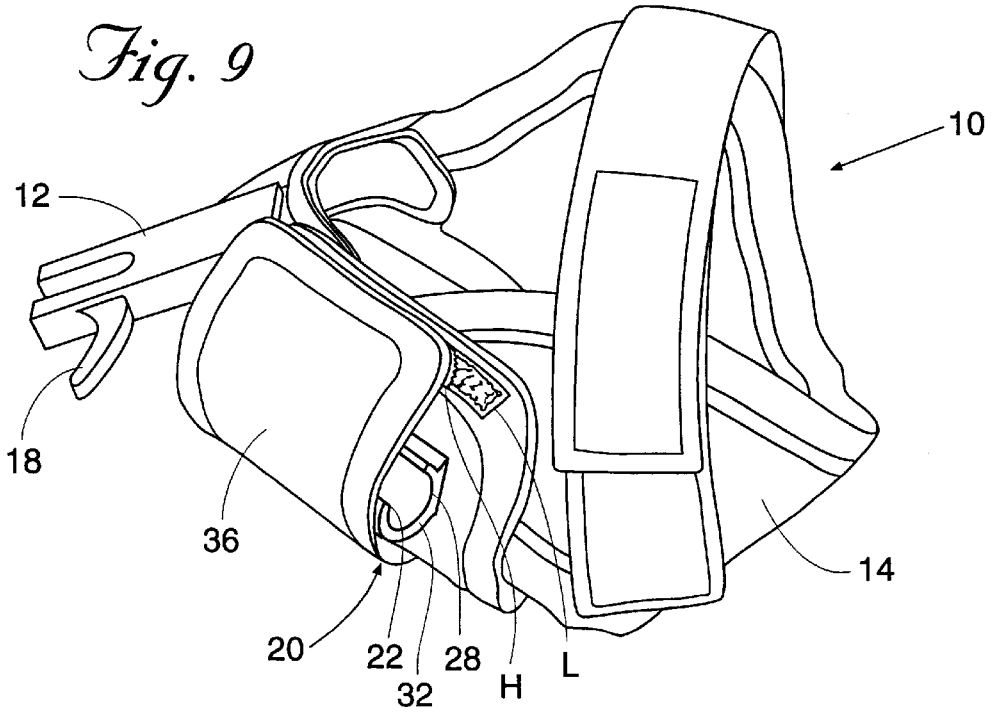
FIG. 9 is a perspective view of a release mounted arrow shaft gripper with an arrow gripping member shroud partially concealing the arrow gripping member.

Referring now to FIG. 9, a release mounted arrow shaft gripper 10 with an arrow gripping member shroud 36 partially concealing the arrow gripping member 20 is shown. The arrow gripping member shroud 36 is preferably a fabric flap coupled with the release body structure 14, although any number of materials could serve as a shroud 36. Other examples include leather, a quiet cloth, or a frictionally enhancing material such as neoprene.

In use, an archer can conceal the arrow gripping member 20, such as during hunting or shooting conditions. The arrow gripping member shroud 36 thus provides a more comfortable grip about the release body structure 14, and decreases the risk of anything snagging on the arrow gripping member 20 during hunting conditions.

If an arrow gripping member shroud 36 is employed, the shroud 36 could have the ability to remain in a partially concealing relationship with the arrow gripping member 20, or could have the ability to completely reveal the arrow gripping member 20 depending on archer preference. If the shroud 36 is employed, the archer when gripping the arrow shaft for removal could grip either the shroud 36 or the arrow gripping member 20.

Figure 10:
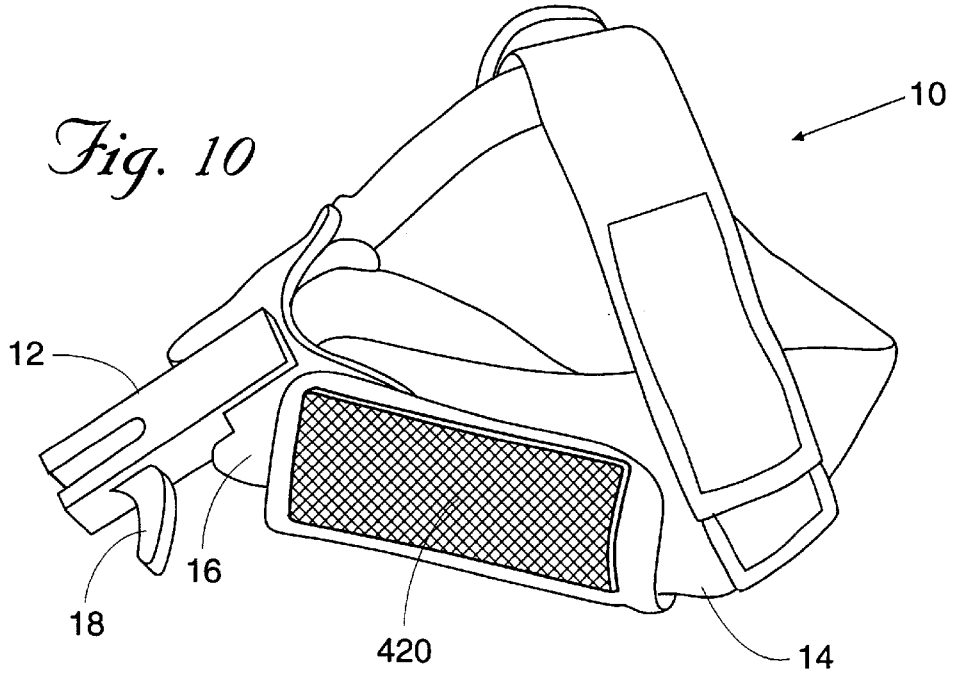
FIG. 10 is a perspective view of a fourth alternate embodiment of a release mounted arrow gripping member.

Referring now to FIG. 10, a fourth alternate embodiment of a release mounted arrow gripping member 420 is shown. In this embodiment, an area of frictionally enhancing material is coupled to the release body structure 14. The release mounted arrow gripping member 420 is not preformed to take the shape of the arrow shaft, but instead drapes itself about the arrow shaft when the archer applies gripping force to the release body 14. As such, the frictionally enhancing material used to manufacture the release mounted arrow gripping member 420 is made of a material of sufficient flexibility for permitting the release mounted arrow gripping member 420 to be pressed about the arrow shaft under typical hand gripping pressure. The release mounted arrow gripping member 420 is best suited to carrying bodies that do not employ a support member coupling body 34, a support member straddle void 24, or a finger pad as disclosed in U.S. Pat. No. 4,509,497 issued to Garvison and U.S. Pat. No. 4,426,989 issued to Sutton. Alternatively, the release mounted arrow gripping member 420 could be used with such carrying bodies, but the support member coupling body 34, support member straddle void 24, or finger pad would have to be formed of a pliable material that also flexingly responds to finger gripping forces. The arrow gripping member 420 could also be provided with a series of ridges to enhance the gripping of the arrow.

Figure 11:
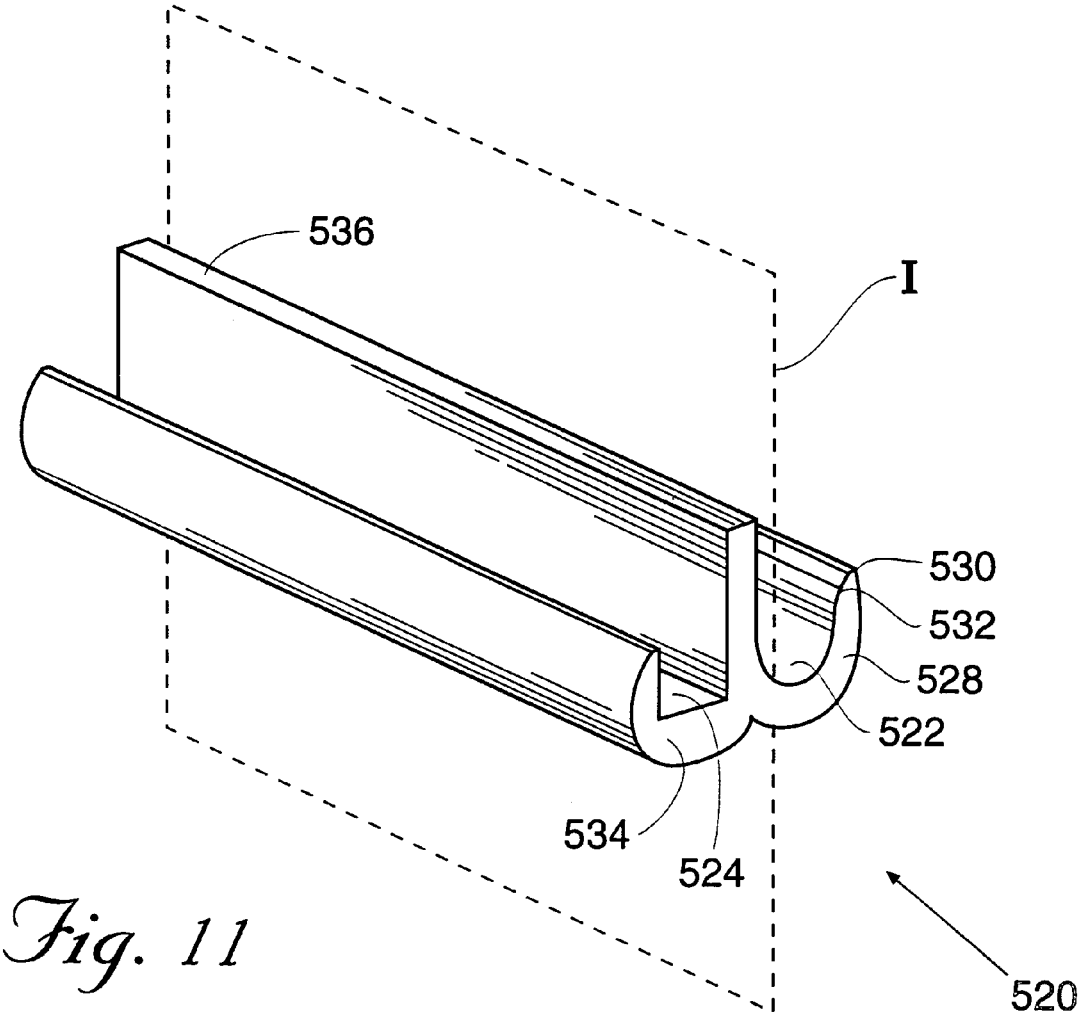
FIG. 11 is a perspective view of a fifth alternate embodiment of a release mounted arrow gripping member.

Referring now to FIG. 11, a perspective view of a fifth alternate embodiment of a release mounted arrow gripping member 520 is shown with a preferred interface I' between concealed and exposed surfaces of the arrow gripping member in phantom. A support member coupling body 534 and the support member straddle void 524 can be carried by the support member 16, and can act as a finger pad, permitting the archer to wrap the fingers around the release body structure 14 and enhance pulling on the bow string. The interface I' is a preferred plane in which a void in the fabric of the release body structure 14 (not shown) can be provided to conceal the support member coupling body 534 and the support member straddle void 524. This void in the fabric also eases fabrication of the release mounted arrow shaft gripper 10.

The support member coupling body 534 includes a middle member 536 that can be used for a stitching surface to couple the release mounted arrow gripping member 520 during fabrication. In this embodiment, a rail 530 is provided, as well as an arrow receiving void 522, an arrow gripping member body 528, and an arrow gripping surface 532.

A method of pulling arrows from a target comprises providing an arrow gripping structure 20 on a bowstring release, the arrow gripping structure 20 having an elongated body 28 comprising one or more rails 30 and an arrow gripping surface 32 coextensive with the rail or rails, the arrow gripping structure adapted for grasping a shaft of an arrow. Next, the archer aligns the arrow shaft roughly parallel with the rails 30 and places the arrow shaft between the rails and against the arrow gripping surface as shown in FIG. 3. Next, as shown in FIG. 4, the archer provides gripping force G to the arrow gripping structure 20, and provides pulling force P from the archer's hand to the arrow gripping structure 20 in a direction away from the target, thus removing the arrow from the target.

In a new method of using a bowstring release, the archer fires an arrow at a target with the release mounted arrow shaft gripper 10, and specifically the release mechanism 12, and then grasps the arrow with the release mounted arrow shaft gripper 10, and specifically the arrow gripping structure 20, as shown in FIG. 3. Next, the archer simultaneously applies pulling pressure P to the release mounted arrow shaft gripper 10, and specifically the arrow gripping structure 20, pulling the entire release mounted arrow shaft gripper 10 away from the target, thereby removing the arrow from the target.

The foregoing is considered as illustrative only of the principles of the invention. Furthermore, because numerous modifications and changes will readily occur to those skilled in the art, it is not desired to limit the invention to the exact construction and operation shown and described. While the preferred embodiment has been described, the details may be changed without departing from the invention, which is defined by the claims.

What is claimed is:

1. A bowstring release for selectively securing and releasing the string of a bow for firing an arrow therefrom, the release comprising:

a release mechanism;

a release body structure;

an arrow gripping structure for selectively grasping an arrow shaft;

wherein the release body structure carries the release mechanism; and wherein the release body structure is coupled with the arrow gripping structure.

2. The bowstring release of claim 1, wherein the arrow gripping structure is formed of a resiliently compressible material.

3. The bowstring release of claim 2, wherein the resiliently compressible material develops cohesiveness with an arrow shaft when the resiliently compressible material is squeezed against the arrow shaft.

4. The bowstring release of claim 2, wherein the resiliently compressible material comprises rubber.

5. The bowstring release of claim 4, wherein the rubber is synthetic.

6. The bowstring release of claim 5, wherein the synthetic rubber is neoprene.

7. The bowstring release of claim 1, wherein the arrow gripping structure is elastomeric.

8. The bowstring release of claim 1, wherein the arrow gripping structure carries a resiliently compressible material.

9. The bowstring release of claim 8, wherein the resiliently compressible material develops cohesiveness with an arrow shaft when the resiliently compressible material is squeezed against the arrow shaft.

10. The bowstring release of claim 8, wherein the resiliently compressible material is elastomeric.

11. The bowstring release of claim 8, wherein the resiliently compressible material comprises rubber.

12. The bowstring release of claim 11, wherein the rubber is synthetic.

13. The bowstring release of claim 12 wherein the synthetic rubber is neoprene.

14. The bowstring release of claim 1, wherein the release body structure is selectively detachably coupled with the arrow gripping structure.

15. The bowstring release of claim 14, wherein the detachable coupling comprises a hook and loop fastening system.

16. The bowstring release of claim 14, wherein the detachable coupling comprises a tongue and groove fastening system.

17. The bowstring release of claim 1 wherein the arrow gripping structure is fixedly coupled with the release body structure.

18. The bowstring release of claim 1, wherein the release body structure comprises a wrist strap assembly.

19. The bowstring release of claim 1, wherein the release body structure comprises a glove assembly.

20. The bowstring release of claim 1, wherein the release body structure comprises a hand-held release structure.

21. The bowstring release of claim 1, the release further comprising a shroud carried by the release body structure.

22. The bowstring release of claim 21, wherein the shroud selectively covers at least a portion of the arrow gripping structure.

23. The bowstring release of claim 1, the arrow gripping structure comprising:

an elongated main body;

a rail disposed on the elongated main body;

an arrow gripping surface coextensive with the rail;

wherein the arrow gripping surface is adapted for grasping an arrow shaft.

24. The bowstring release of claim 23, wherein the arrow gripping structure is substantially semi-circular in cross section.

25. The bowstring release of claim 23, the release body structure further comprising a support member carried by the release body structure.

26. The bowstring release of claim 25, the arrow gripping structure further comprising:

a support member coupling body coupled with the elongated main body;

a void disposed on the support member coupling body adapted for receiving the support member.

27. The bowstring release of claim 26, wherein the support member coupling body is the same length as the elongated main body.

28. The bowstring release of claim 26, wherein a void disposed on the release body lies between the support member coupling body and the elongated main body.

29. The bowstring release of claim 25, the arrow gripping structure further comprising a middle member disposed between the support member coupling body and the elongated main body.

30. The bowstring release of claim 23, wherein the arrow gripping structure is substantially planar.

31. The bowstring release of claim 23, the arrow gripping structure further comprising:

a plurality of finger grip depressions disposed on an exterior surface of the elongated main body adapted for receiving at least one of an archer's fingers.

32. In a bowstring release for selectively securing and releasing the string of a bow for firing an arrow therefrom, the combination of an arrow gripping structure coupled with a release body structure.

33. A bowstring release according to claim 32, wherein the release body structure is a glove assembly.

34. A bowstring release according to claim 32, wherein the release body structure is a wrist strap assembly.

35. A bowstring release according to claim 32, wherein the release body structure is a hand-held release assembly.

36. A bowstring release for selectively securing and releasing the string of a bow for firing an arrow therefrom, the release comprising:

a release mechanism;

means for securing the release about a wrist of an archer;

means for carrying the release mechanism with the means for securing the release about a wrist of an archer;

means for grasping a shaft of an arrow, said means for grasping the shaft of the arrow coupled with said means for securing the release about the wrist of the archer.

37. A bowstring release for selectively securing and releasing the string of a bow for firing an arrow therefrom, the release comprising:

a release mechanism;

means for securing the release about a hand of an archer and carrying the release mechanism;

means for grasping a shaft of an arrow, said means for grasping the shaft of the arrow coupled with said means for securing the release about the hand of the archer.

38. A method of pulling arrows from a target, the method comprising:

providing an arrow gripping structure on a bowstring release, the arrow gripping structure having an elongated body comprising a rail and an arrow gripping surface coextensive with the rail, the arrow gripping structure adapted for grasping a shaft of an arrow;

aligning the arrow shaft roughly parallel with the rail;

placing the arrow shaft against the arrow gripping surface;

providing gripping force from an archer's hand to the arrow gripping structure;

providing pulling force from the archer's hand to the arrow gripping structure in a direction away from the target;

removing the arrow from the target.

39. A method of pulling arrows from a target, the method comprising:

providing a bowstring release comprising a means for grasping a shaft of an arrow and a means for releasing the bowstring;

engaging the shaft of the arrow with the means for grasping the shaft of the arrow;

providing gripping force from an archer's hand to the means for grasping the shaft of the arrow;

providing pulling force from the archer's hand to the means for grasping the shaft of the arrow;

removing the arrow from the target.

40. A method of using a bowstring release to assist in shooting and retrieving an arrow, the method comprising:

providing a bowstring release comprising a means for grasping a shaft of an arrow in combination with a means for selectively securing and releasing the string of the bow for firing an arrow;

firing an arrow at a target from the bow by releasing the bowstring with the bowstring release, and embedding the arrow into the target at least partially;

grasping the shaft partially embedded in the target with the means for grasping the shaft;

pulling the bowstring release away from the target while grasping the means for grasping the shaft, thereby removing the arrow from the target.

* * * * *